US010336594B2

(12) United States Patent
Geilsdorf et al.

(10) Patent No.: US 10,336,594 B2
(45) Date of Patent: Jul. 2, 2019

(54) METHOD FOR OPERATING AN INDUSTRIAL TRUCK WITH AN OPERATING ELEMENT

(71) Applicant: Jungheinrich Aktiengesellschaft, Hamburg (DE)

(72) Inventors: Hendrik Geilsdorf, Hamburg (DE); Jörn Sellentin, Kaltenkirchen (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 0 days.

(21) Appl. No.: 15/720,192

(22) Filed: Sep. 29, 2017

(65) Prior Publication Data

US 2018/0086613 A1 Mar. 29, 2018

(30) Foreign Application Priority Data

Sep. 29, 2016 (DE) ..... 10 2016 118 458

(51) Int. Cl.

| | |
|---|---|
| ***B66F 9/12*** | (2006.01) |
| ***B66F 9/075*** | (2006.01) |
| ***B66F 9/14*** | (2006.01) |
| ***B66F 9/20*** | (2006.01) |
| ***B66F 17/00*** | (2006.01) |
| ***G05G 5/03*** | (2008.04) |
| ***G05G 9/047*** | (2006.01) |

(52) U.S. Cl.

CPC ..... *B66F 9/12* (2013.01); *B66F 9/0755* (2013.01); *B66F 9/143* (2013.01); *B66F 9/149* (2013.01); *B66F 9/20* (2013.01); *B66F 17/003* (2013.01); *G05G 5/03* (2013.01); *G05G 9/047* (2013.01)

(58) Field of Classification Search

CPC ..... B66F 9/12; B66F 17/003; B66F 9/0755; B66F 9/149; B66F 9/143; B66F 9/20; G05G 9/047; G05G 5/03

See application file for complete search history.

(56) References Cited

U.S. PATENT DOCUMENTS 5,228,356 A * 7/1993 Chuang ..... G05G 9/047 200/6 A
5,513,100 A * 4/1996 Parker ..... G05B 19/427 318/568.18

(Continued)

FOREIGN PATENT DOCUMENTS

DE 19949802 A1 4/2001
DE 10015707 A1 10/2001

(Continued)

OTHER PUBLICATIONS

EP 17193227; Filed Sep. 26, 2017; European Search Report dated Feb. 27, 2018; 7 pages.

*Primary Examiner* — Darlene P Condra
(74) *Attorney, Agent, or Firm* — Barclay Damon LLP

(57) ABSTRACT

A method for operating an industrial truck with an operating element comprising at least one operating for a vehicle function, an unlocking apparatus for the vehicle function, and a resetting apparatus configured to interact with the at least one operating lever generating a resetting force depending on a deflection of the least one operating lever. Upon an actuation of the operating lever without previously unlocking the operating lever, the resetting force acting on the at least one operating lever is changed in order to report an unsuccessful unlocking procedure.

17 Claims, 6 Drawing Sheets

(56) References Cited

U.S. PATENT DOCUMENTS

| | | | | |
|---|---|---|---|---|
| 6,437,771 | B1 * | 8/2002 | Rosenberg | A63F 13/06 345/156 |
| 6,462,731 | B1 * | 10/2002 | Stoffers | G05G 9/047 345/156 |
| 6,932,113 | B1 | 8/2005 | Kauss | |
| 8,781,642 | B2 | 7/2014 | Tarasinski | |
| 2002/0080116 | A1 * | 6/2002 | Onodera | G05G 1/10 345/161 |
| 2015/0033899 | A1 | 2/2015 | Geilsdorf et al. | |
| 2015/0268691 | A1 | 9/2015 | Schaub et al. | |

FOREIGN PATENT DOCUMENTS

| | | | |
|---|---|---|---|
| DE | 10304658 | A1 | 8/2004 |
| DE | 102005012004 | A1 | 10/2005 |
| DE | 102005000633 | A1 | 7/2006 |
| DE | 102007021499 | A1 | 11/2008 |
| DE | 10213012176 | A1 | 1/2015 |
| DE | 102014103988 | A1 | 9/2015 |
| WO | 2016/019091 | A1 | 2/2016 |
| WO | 2016019091 | A1 | 2/2016 |

* cited by examiner

METHOD FOR OPERATING AN INDUSTRIAL TRUCK WITH AN OPERATING ELEMENT

CROSS REFERENCE TO RELATED INVENTION

This application is based upon and claims priority to, under relevant sections of 35 U.S.C. § 119, German Patent Application No. 10 2016 118 458.6, filed Sep. 29, 2016, the entire contents of which are hereby incorporated by reference.

BACKGROUND

The invention generally relates to a method for operating an industrial truck with an operating element.

Numerous different concepts and approaches for operating elements are known for operating and controlling industrial trucks. For example, a control element for an industrial truck is known from DE 10 2013 012 176 that has two operating levers and at least one switch arranged therebetween. The operating levers are each designed for a two-axial movement and are spatially separate from each other such that the fingers of a hand positioned between the levers can actuate the operating levers without grasping, and can actuate the at least one switch between the operating levers.

DE 10 2005 000 633 A1 disclosed providing vibration in the control element and/or the driver's seat as feedback for vehicle states and/or vehicle information. This is haptic feedback of vehicle states and/or vehicle information. When the control element is embodied as a joystick, there is reliable and direct feedback of vehicle states and/or vehicle information by electromagnets generating vibrations, or an electric motor interacting with an unbalanced mass.

Control elements designed as a joystick are known from DE 10 2014 103 988 A1 for controlling commercial vehicles, machines, work functions of commercial vehicles or construction machines and attachments. The use of force feedback is also known for the joysticks. Force feedback is mechanical feedback which is normally achieved by coupled torque of an electric motor with the assistance of a gear unit. Different technical embodiments of the actuating lever of the joystick are known for implementing force feedback.

A key aspect in the operation of an industrial truck is its stability. Variables that influence the stability are the load weight, distance from the load's center of gravity, lifting height and tilt of the mast. In addition to these static variables, there are dynamic processes that have an influence on stability such as braking, reverse acceleration, driving in a curve, etc. A number of different approaches are known for determining stability. In one approach, the force or pressure is measured at different positions of the vehicle. Other approaches such as those in DE 100 15 707 A1, DE 103 04 658 A1 or DE 10 2005 012 004 A1 are based on model-based considerations.

BRIEF SUMMARY OF THE INVENTION

The object of the invention is to provide a method for operating an industrial truck with a lockable operating element, as well as such a vehicle in which the unlocking process is easily and ergonomically feasible for the user.

The method according to the invention is provided and intended for operating an industrial truck with an operating element. The operating element possesses at least one operating lever for a vehicle function, and an unlocking apparatus for this vehicle function. Frequently, a requirement for industrial trucks is that additional approval by the driver must be given before hazardous movements of the load. Hazardous movements can for example be opening a clamping attachment, or rotating a rotating attachment. Moreover, a resetting device is provided that interacts with the at least one operating lever which exerts a resetting force depending on a deflection of the least one operating lever. According to the invention, upon an actuation of the operating lever without previously unlocking its function, the resetting force acting on the at least one operating lever is changed in order to report an unsuccessful unlocking procedure. The invention is based on the awareness that when the operator has forgotten to unlock or release the desired function, it can take a while until the operator recognizes his error. In the method according to the invention, the operator is provided with a haptic response by the changed resetting force on the operating element that the unlocking process has not yet been executed. This prevents downtime and delays in operating the industrial truck since the user is provided with an immediate response to his forgotten release of the procedure.

Of the possible vehicle functions that require unlocking before their actuation, the fork adjuster is of particular interest. With the fork adjuster, the forks of a load bearing means are adjusted relative to each other in terms of their distance. The unlocking is effectuated in this instance by a sensor and not from an actuation by the user. If the load sensor detects a load on the forks, an actuation of the fork adjusting unit is blocked. An actuation of the fork adjuster is released only when the load sensor does not detect any load on the load bearing means. The absence of a release of the fork adjuster is also indicated to the user by a change in the resetting force on the control lever to remind him that a fork adjustment is not possible when a load has been taken.

In an embodiment, the unlocking apparatus is manually actuated by the user independent of the actuating element. The unlocking apparatus can in this instance have for example a button, switch, slider or comparable unlocking means.

In an embodiment, the resetting device blocks a movement of the at least one operating lever until the unlocking apparatus has been actuated. In this case, the unlocking device, as explained above, can either be blocked or actuated by load sensor by an additional unlocking means to be actuated by the user. A blocked operating lever notifies the user that the position that he desires to actuate is not released for actuation. The operating lever is preferably blocked by increasing the resetting force of the resetting device to the extent that it cannot be easily overcome while actuating. In addition to blocking the operating lever, it is also possible to increase the resetting force without its actuation being completely blocked.

The operating element possesses at least one operating lever for a vehicle function, and an unlocking apparatus for this vehicle function. Moreover, a resetting apparatus is provided that interacts with the at least one operating lever, which indicates a resetting force depending on a deflection of the least one operating lever. Before the unlocking device is actuated, the resetting apparatus indicates the resetting force to the operating lever before an actuation of the unlocking device such that, if that the vehicle function has not been unlocked, the user is notified thereof. The feedback to the user can prevent delays in operating the industrial truck.

In an embodiment, a fork adjustor is provided, and the unlocking apparatus comprises a load sensor. The actuation apparatus for the fork adjuster is blocked when the load sensor detects a load. The operator who attempts to actuate the fork adjusting apparatus even though a load is on the load carrying means is reminded by the blocked actuating apparatus that the held load is endangered by actuating the fork adjuster.

In an embodiment, the unlocking apparatus has an independent unlocking means that can be actuated by an operating lever. The unlocking means can, for example, be a button, a switch, a slide or another component that can be actuated. For the task as an unlocking device, it is important for the unlocking means to be able to be used and operated independent of the actuating apparatus.

In one embodiment, the industrial truck comprises a clamping and/or rotating attachment. The unlocking apparatus must be actuated beforehand to actuate the clamping and/or rotating attachment. By actuating the unlocking apparatus, a movement of the load with the attachment is released.

In an embodiment, the resetting device may block a movement of the at least one operating lever until the unlocking apparatus has been actuated. The unlocking apparatus can be actuated by an unlocking means by the user or, for example, by a load sensor that for example detects a missing load.

In an embodiment, the resetting device may increase the resetting force when the at least one operating lever is moved without the unlocking apparatus being actuated beforehand. In this embodiment, the user experiences a very large resetting force acting on the operating lever once it is actuated. For the operating person, this creates the impression of a blocked operating lever that is at its maximum stop.

In addition to blocking the operating lever, it is also possible to tangibly increase the resetting force. In this case as well, an operating person is made aware of the absence of unlocking. To amplify this effect, it is possible to vary the resetting force in a pulsating manner which particularly grabs the attention of the operating person. The advantage over vibration in the operating lever is that the operating lever not only changes its position, the operating person only changes the force over time necessary for holding while the position remains same.

BRIEF DESCRIPTION OF THE DRAWINGS

A preferred embodiment of the invention is explained in greater detail below. In the following.

DETAILED DESCRIPTION OF THE INVENTION

Figure 1:
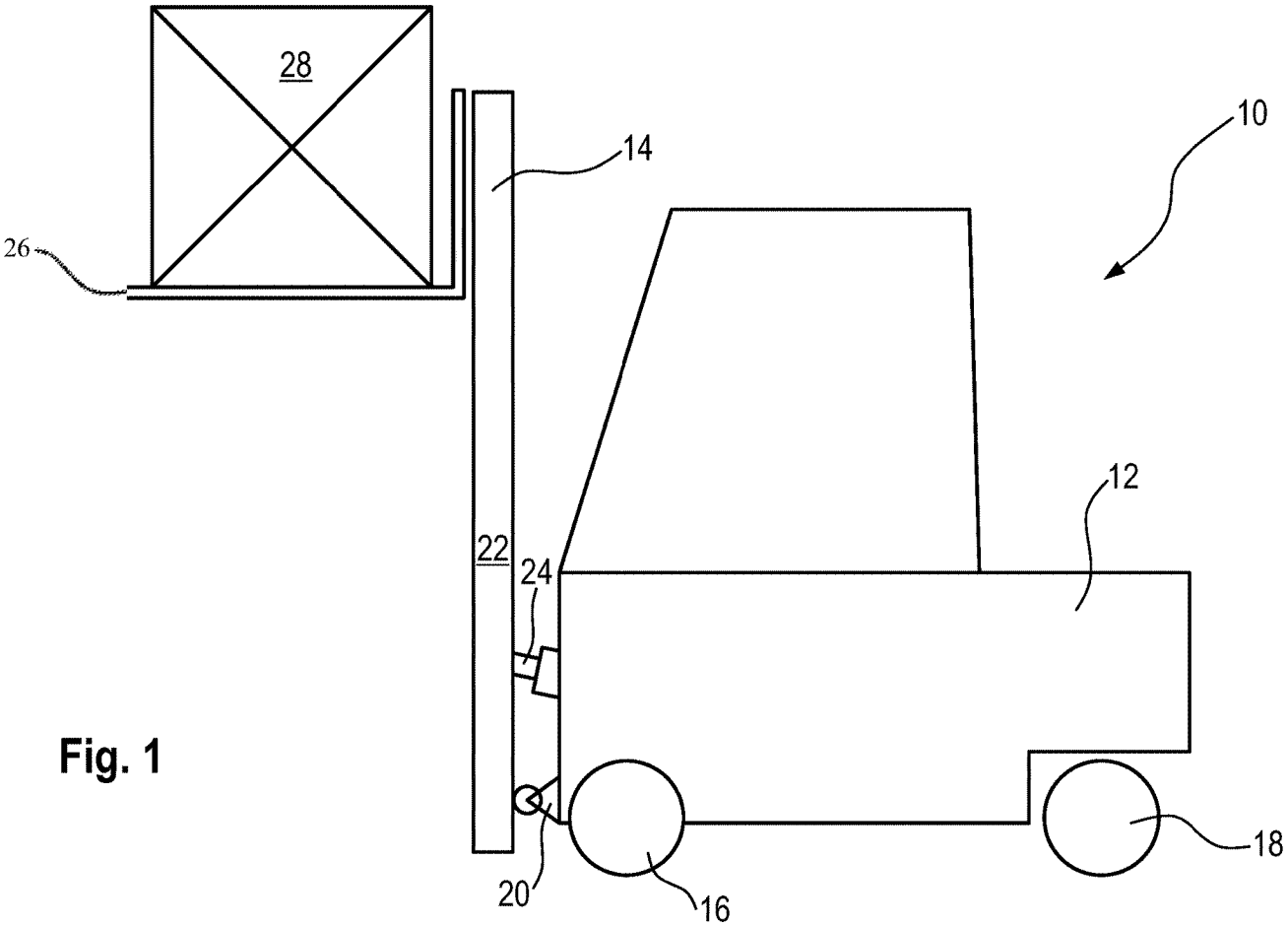
FIG. 1 illustrates a schematic view of an embodiment of an industrial truck.

FIG. 1 shows a counterbalance truck or an industrial truck 10 which has a drive part 12 and a load part 14. The drive part 12 possesses two front wheels 16 and one or two rear wheels 18 depending on the design of the chassis. A lifting mast 22 is coupled to the drive part 12 at an articulation point 20 and is configured to pivot about the articulation point 20. The lifting mast 22 can be tilted forward or backward by means of a tilt cylinder 24. In this case, the lifting mast 22 comprises a forked load carrying means 26 on which a load 28 is disposed. In principle, other load carrying means can also be arranged on the lifting mast 22. It is therefore possible to provide a fork adjuster that permits varying the distance between the forks (FIG. 5), clamping a load to be transported, for example in the form of a roller (FIG. 3), or pivoting a held load (FIG. 4).

Since, with industrial trucks it is mandatory that the driver provide additional approval before hazardous movements, a locking function can also be provided for tilting the mast 22 when a load 28 is lifted. When there is a locking function, a forward tilt is only possible after a certain load height when the driver has locked this function.

Figure 2:
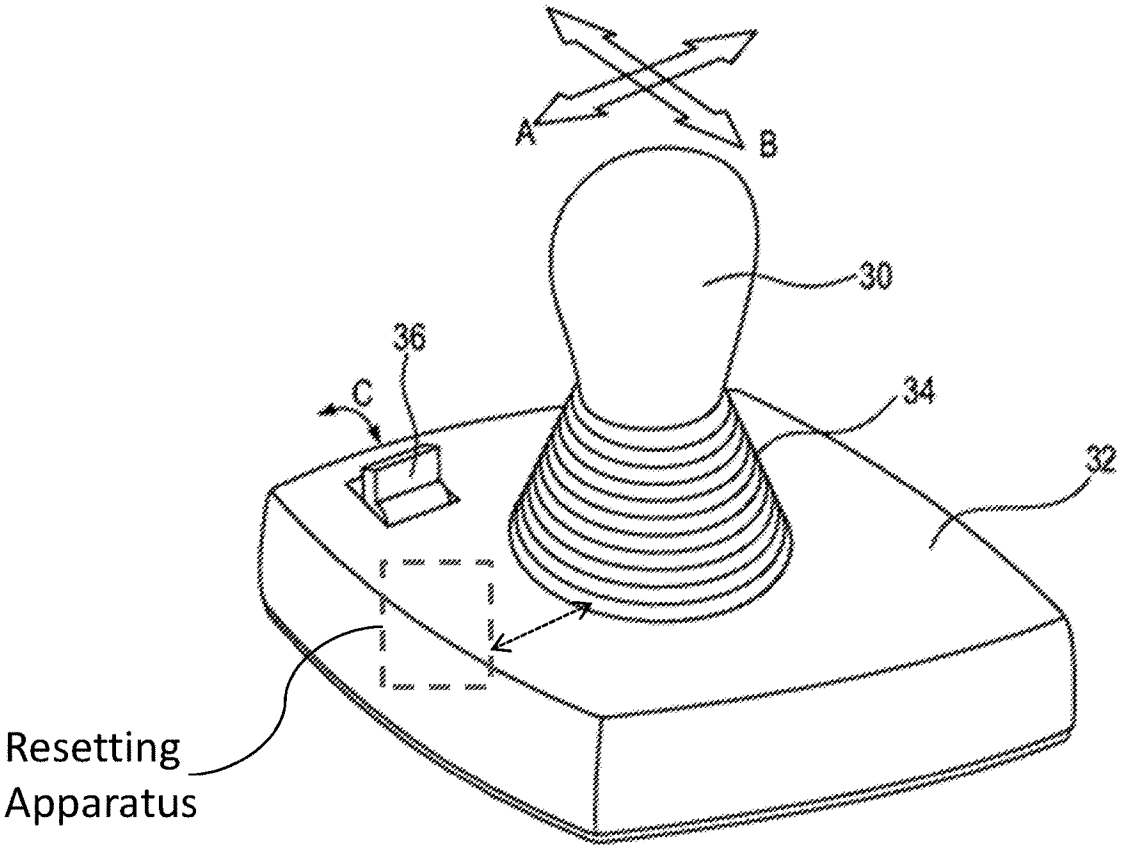
FIG. 2 illustrates an operating lever and an unlocking switch of an embodiment of an operating element of the industrial truck.

FIG. 2 shows an operating lever 30 that can be pivoted along the A and B axes. The operating lever 30 may comprise a ball-shaped head on which the palm of the user's hand rests. In contrast to the base 32, the operating lever 30 may comprise an elastic sleeve 34 on its bottom that permits a movement of the lever 30. An unlocking lever or switch 36 may be positioned close to the operating lever 30. The unlocking lever can be actuated along the double arrow C in order to move the unlocking lever into an unlocked state.

Different vehicle functions can be saved by actuating the operating lever 30 along either the A or B axes. By a movement in the plane covered by both axes, both functions can be overlapped. A resetting force can be generated with the resetting device for each of the A and B axes. The resetting force may be generally proportional to the deflection of the operating lever 30 in order to give the operating person a haptic feedback. In an embodiment, an operating lever with one-dimensional actuation can also be provided.

Figure 3:
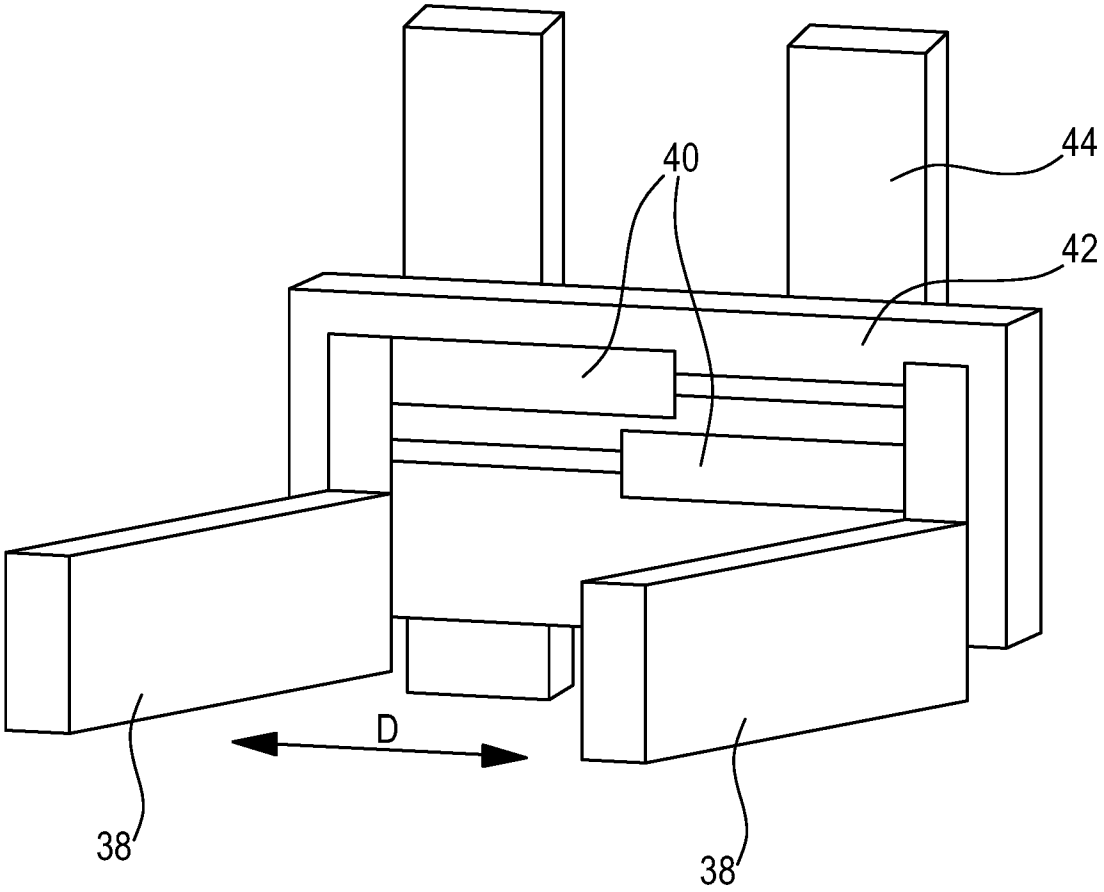
FIG. 3 illustrates an embodiment of a clamping attachment for the industrial truck.
Figure 4:
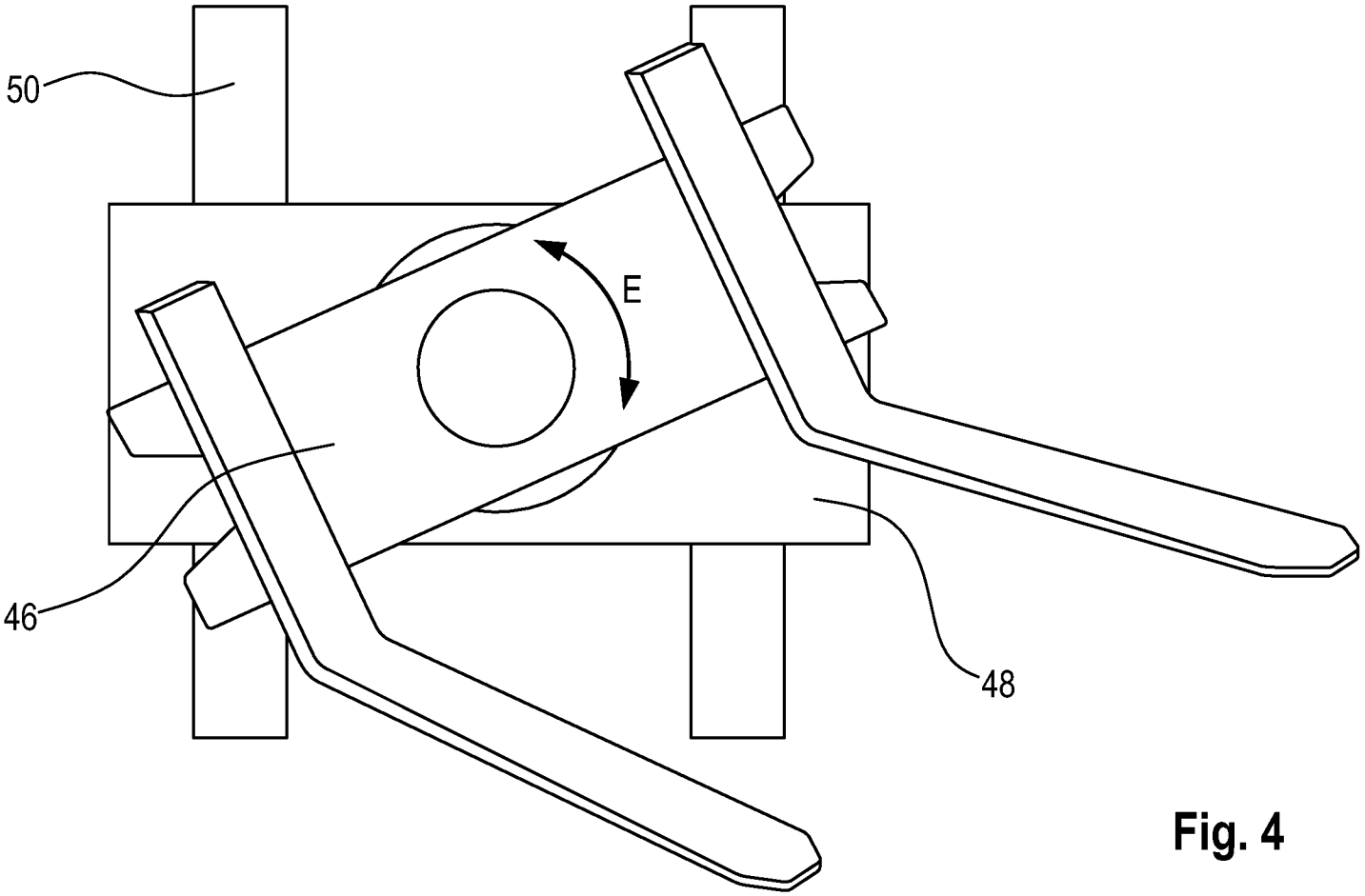
FIG. 4 illustrates an embodiment of a load carriage for the industrial truck.

FIG. 3 shows a clamping attachment that comprises two flat box-shaped clamps 38. The distance D between the clamps 38 can be adjusted by two adjusting cylinders 40. The clamps 38 may be configured to move along a load carriage 42, which is attached in a height-adjustable manner on a lifting mass 44. The distance D between the clamps 38 may be adjusted by actuation of the operating lever 30 (FIG. 2) along the A axis. In this case, actuating the operating lever 30 along the A axis is only possible when the unlocking apparatus 36 has been actuated beforehand to enable adjustment of distance D. Otherwise, the actuation of the operating lever 30 along the A axis is locked.

FIG. 4 shows a rotatable fork carriage 46 that is rotatably mounted to a load carriage 48 by a rotating unit (not visible) and is configured to rotate about an axis in a direction E. The load carriage 48 is adjustable in height along the lifting mast 50. Rotating or pivoting the rotatable fork carriage 46 along the direction E can be used to pour out bulk goods or liquids that are arranged in a container on the rotatable fork carriage 46. Other uses of the rotatable fork carriage 46 are also conceivable. A rotary movement along direction E is also locked in this case and can only be activated when the associated unlocking device has been actuated.

Figure 5:
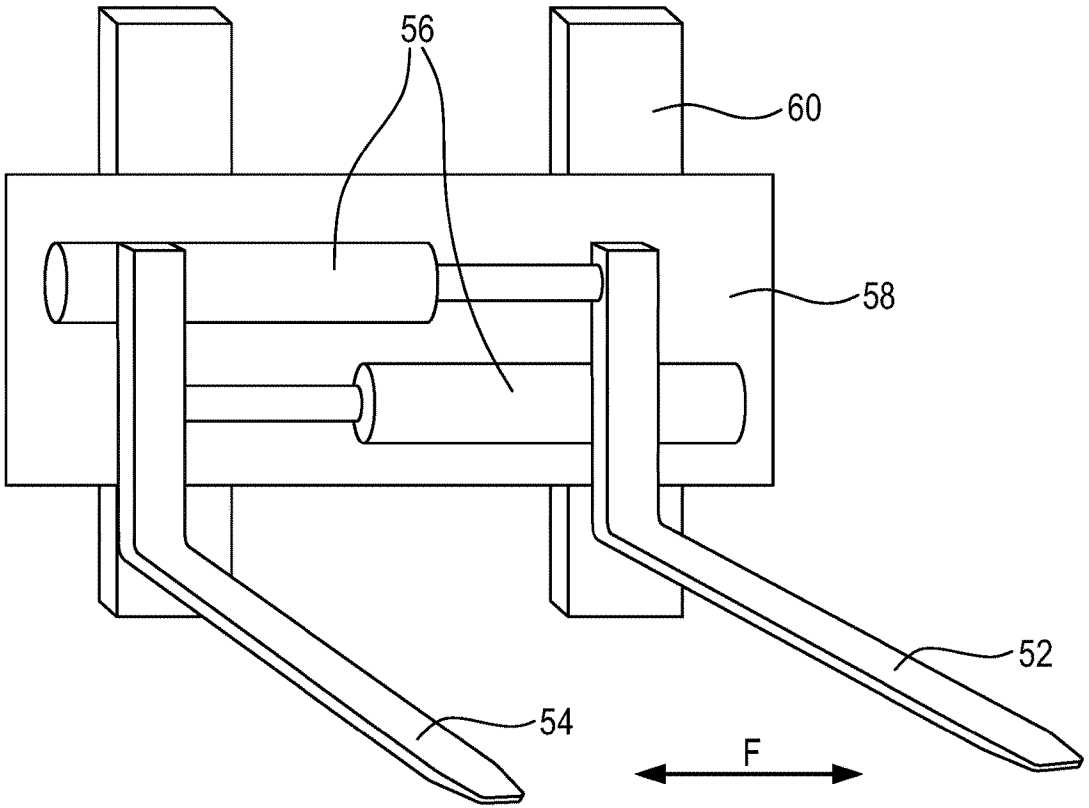
FIG. 5 illustrates an embodiment of a fork adjuster attachment for the industrial truck.

FIG. 5 shows a fork adjuster in which the distance F between the forks 52 and 54 can be adjusted by two adjusting cylinders 56. The adjusting cylinders 56 with the forks 52, 54 are arranged on a load carriage 58 that can be adjusted in height along the lifting mast 60. Adjustment of the distance F between the forks 52, 54 can be locked by an unlocking switch 36 (FIG. 2). It is also possible to provide a load sensor for the forks 52, 54. The load sensor detects a load 28 (FIG. 1) on the forks 52, 54. When there is a load 28 (FIG. 1) on the forks 52, 54, adjustment of distance F between the forks 52, 54 is in principle locked. The distance F can only be adjusted when there is no load 28 (FIG. 1) on the forks 52, 54. If a load sensor is used, it is also possible for an adjustment of distance F to be directly released when there is no load 28 (FIG. 1). It is also possible to require actuation of an unlocking switch when there is no load 28 (FIG. 1) in order to adjust the distance between the forks 52, 54.

Figure 6:
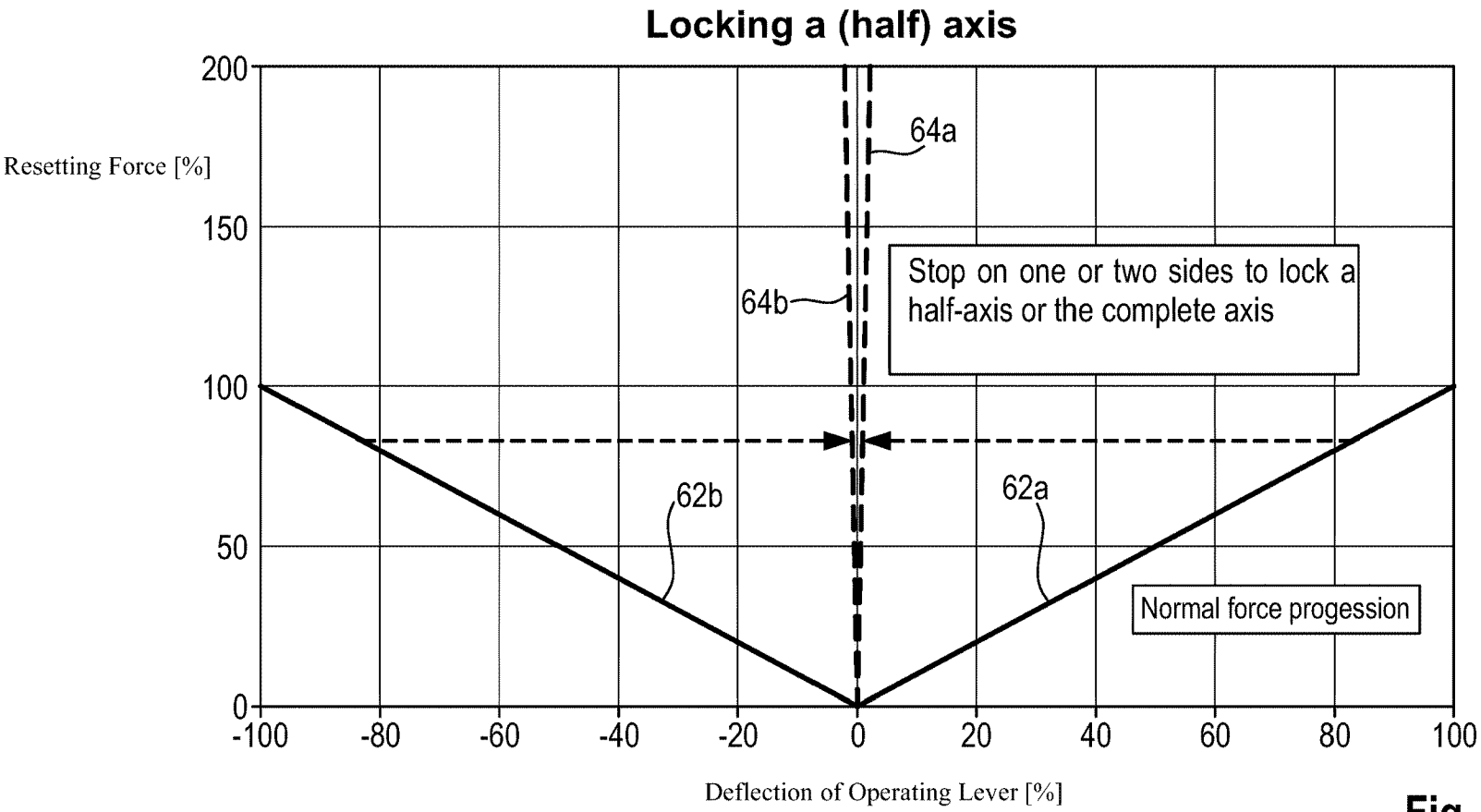
FIG. 6 illustrates a curve demonstrating the relationship between the resetting force and the deflection of the operating lever.

FIG. 6 shows the curves (or lines) 62*a*, 62*b* of a resetting force depending on the deflection of the operating lever 30 (FIG. 2). The normal force curves drawn with a continuous line correspond to a resetting force of 100% with 100% deflection. The resetting force is plotted here without a sign as an absolute amount in arbitrary units. Given a deflection of +20%, the resetting force along line 62*a* is the same size as the resetting force along line 62*b*; both resetting forces are aligned to reset the operating lever in its home position with 0% deflection.

In the invention, the resetting force is adjusted along the dashed curve 64*a*, 64*b*. The curve 64*a* causes a very large resetting force to be already experienced upon a minimum deflection in a positive direction so that further actuation of the operating lever is impossible. The steep curves 64*a*, 64*b* function like end stops and accordingly block actuation of the operating element in the corresponding direction. As shown in FIG. 6, the blocking occurs optionally for individual directions. It is possible to a stipulate a curve of 62*b* and 64*a*, whereby there is only blocking in a positive deflection. Likewise by the combination of 64*b* and 62*a*, there can be a one-sided block for a negative deflection.

The particular advantage of using the resetting device is that it can be flexibly used in the operating element.

In a development of the curve of the resetting force shown in FIG. 6, the slope of the resetting force curves 64*a*, 64*b* can be varied so as to pulse. By varying the resetting forces over time, an operating person who presses the operating lever against the resetting force experiences a pulsing resetting force which moreover reminds him that the function is blocked.

REFERENCE LIST

10 Industrial truck
12 Drive part
14 Load part
16 Front wheel
18 Rear wheel
20 Articulation point
22 Lift mast
24 Tilt cylinder
26 Load bearing means
28 Load
30 Operating lever
32 Base
34 Elastic sleeve
36 Unlocking apparatus
38 Box-shaped clamp
40 Adjusting cylinder
42 Load carriage
44 Lift mast
48 Load carriage
50 Lift mast
52 Forks
54 Forks
56 Adjusting cylinder
58 Load carriage
60 Lift mast
62*a* Resetting force
62*b* Resetting force
64*a* Resetting force
64*b* Resetting force

The invention claimed is:

1. A method for operating an industrial truck with an operating element comprising at least one operating for a vehicle function, an unlocking apparatus for the vehicle function, and a resetting apparatus configured to interact with the at least one operating lever, the method comprising:

generating a resetting force depending on a deflection of the least one operating lever, wherein the resetting force acting on the at least one operating lever is changed in order to report an unsuccessful unlocking procedure upon activation of the operating lever without previously unlocking the operating lever.

2. The method according to claim 1, wherein the industrial truck further comprises a fork adjuster and the unlocking apparatus further comprises a load sensor, and wherein actuation of the fork adjuster is locked when the load sensor detects a load.

3. The method according to claim 1, wherein the unlocking apparatus is configured to actuate independent of the operating lever.

4. The method according to claim 1, wherein the resetting apparatus is configured to block a movement of the at least one operating lever until the unlocking apparatus has been actuated.

5. The method according to claim 1, wherein the unlocking apparatus is configured to be actuated before an attachment can be actuated.

6. The method according to claim 5, wherein the attachment is one of a clamping attachment or rotating attachment.

7. The method according to claim 1, wherein the resetting apparatus is configured to increase the resetting force when the at least one operating lever is moved without the unlocking apparatus being actuated beforehand.

8. The method according to claim 7, wherein the resetting apparatus is configured to increase the resetting force in a pulsating manner when the at least one operating lever is moved without the unlocking apparatus being actuated beforehand.

9. An operating element for an industrial truck comprising:

at least one operating lever configured for a vehicle function;

an unlocking apparatus configured for the vehicle function; and a resetting apparatus configured to interact with the at least one operating lever to indicate a resetting force depending on a deflection of the least one operating lever, wherein the resetting apparatus is configured to indicate the resetting force to the at least one operating lever before an actuation of the unlocking apparatus to provide feedback that an unlocking procedure has not occurred.

10. The operating element according to claim 9, further comprising:

a fork adjuster comprising an actuating apparatus; and a load sensor disposed on the unlocking apparatus, wherein the actuating apparatus for the fork adjuster is locked when the load sensor detects a load.

11. The operating element according to claim 9, wherein the unlocking apparatus has an unlocking means configured to be actuated independent of the operating lever.

12. The operating element according to claim 11, wherein the unlocking means comprises at least one of a button, a switch, or a slide.

13. The operating element according to claim 11, wherein the unlocking means comprises a component configured to be actuated.

14. The operating element according to claim 9, further comprising at least one of a clamping or rotating attachment configured to be actuated after a locking apparatus is actuated.

15. The operating element according to claim 9, wherein the resetting apparatus is configured to block a movement of the at least one operating lever until the unlocking apparatus has been actuated.

16. The operating element according to claim 9, wherein the resetting apparatus is configured to increase the resetting force when the at least one operating lever is moved without the unlocking apparatus being actuated beforehand.

17. The operating element according to claim 9, wherein the resetting apparatus is configured to change the resetting force in a pulsating manner when the at least one operating lever is moved without the unlocking apparatus being actuated beforehand.

* * * * *